US005501345A

United States Patent [19]

Hilstolsky et al.

[11] Patent Number: 5,501,345

[45] Date of Patent: Mar. 26, 1996

[54] GARMENT HOLDER ASSEMBLY

[75] Inventors: Frank J. Hilstolsky, Dallas; Westcoat Beakley, Carverton; Raymond A. Longo, Wilkes-Barre; William H. Scott, Mountaintop, all of Pa.

[73] Assignee: Metro Industries, Inc., Reno, Nev.

[21] Appl. No.: 151,805

[22] Filed: Nov. 15, 1993

[51] Int. Cl.[6] ..... A47F 5/00

[52] U.S. Cl. ..... 211/113; 211/116; 211/119

[58] Field of Search ..... 211/119, 118, 211/113, 116; 248/340

[56] References Cited

U.S. PATENT DOCUMENTS

| | | | |
|---|---|---|---|
| 2,577,397 | 12/1951 | Bailey | 211/119 X |
| 4,079,840 | 3/1978 | Usner | 211/124 |
| 4,140,163 | 2/1979 | Usner | 150/5 |
| 4,253,577 | 3/1981 | Macfarlane | 211/118 |
| 4,429,797 | 2/1984 | Collins | 211/119 |
| 4,557,516 | 12/1985 | Usner | 294/143 |
| 4,704,969 | 11/1987 | Schonenberger | 211/119 X |
| 4,779,746 | 10/1988 | Usner | 211/124 |
| 4,893,715 | 1/1990 | Papazian et al. | 211/119 X |
| 5,050,833 | 9/1991 | Usner | 248/340 |
| 5,067,620 | 11/1991 | Norrie | 211/113 |
| 5,107,996 | 4/1992 | Whittaker | 211/113 X |

*Primary Examiner*—Robert W. Gibson, Jr.

*Attorney, Agent, or Firm*—Fitzpatrick, Cella, Harper & Scinto

[57] ABSTRACT

A garment holder assembly supports garments while being disposed in either of two different attitudes. The assembly includes an elongated rigid support structure with a plurality of spaced, interior dividers. A hook extends from one or more dividers to support the garment holder assembly in a horizontal attitude. A link secured to one end of the support structure can be connected to a hook for supporting the assembly in a vertical attitude.

18 Claims, 4 Drawing Sheets

GARMENT HOLDER ASSEMBLY

BACKGROUND OF THE INVENTION

1. Field of the Invention

The present invention relates generally to a device for holding garments hung on hangers, and more particularly to a garment holder assembly capable of supporting garments while positioned in two different attitudes.

The garment holder assembly of the present invention can be used, for example, with a conventional two-rail garment supporting system often used in garment warehouses or at laundries for storing such articles and carrying them to trucks for shipment to other locations. As shown in FIG. 1, such a two-rail system 11 comprises an upper rail 13 that is usually stationary, although it can be transportable, and a lower, or trolley rail, 15 that is suspended from the upper rail by a plurality of roller hooks 17. The hooks are secured to the trolley rail by welding or other fastening means, for example, and have rollers (not shown) at their top end that rest on the upper rail. In this way, the trolley rail can slide relative to the upper rail. The trolley rail can support a plurality of individual garments on conventional hangers or one or more garment holder assemblies each holding a plurality of garments. The two-rail garment supporting system thus can support a large number of garments and allow them to be conveniently moved by sliding the trolley rail along the upper rail.

2. Description of the Prior Art

One type of conventional garment holder hangs vertically from a roller hook and supports garments at different vertical heights. Such a garment holder is shown in FIG. 2 to comprise a soft knot lanyard 21 having a plurality of knots 23 at different vertical heights for supporting hangers 25. The lanyard is supported from a horizontal rail, such as the trolley rail 15 shown in FIG. 1, by a hook 27 having rollers 29 at its top curved end.

The conventional garment holder shown in FIG. 2 is acceptable for temporarily supporting a plurality of garments when, for example, the garments are being transported in a truck. Hanging the garments from a vertically disposed garment holder saves space and allows a maximum amount of garments to be transported. One drawback, however, is that the garments lie on top of one another when supported in the manner shown in FIG. 2 and tend to become wrinkled more easily. Therefore, when the garments are to be supported for an extended period of time in, for example, a warehouse, it is preferable that the garments hang side-by-side from a horizontal support assembly.

If a garment holder of the type shown in FIG. 2 is used to transport the garments, the individual garments must be transferred to and from a horizontal garment holder to the vertical garment holder. This procedure requires excessive time and effort.

While a garment holder of the type described above is known, further improvements in garment holders are desirable.

SUMMARY OF THE INVENTION

It is a general object of the present invention to provide a garment holder assembly that improves upon garment holders known in the art.

It is an object of the present invention to provide a garment holder assembly that can be disposed in both a horizontal attitude and a vertical attitude for supporting the garments.

It is another object of the present invention to provide a garment holder assembly that reduces the amount of loading and unloading of garments on the assembly.

It is a further object of the invention to provide a garment holder assembly that reduces the amount of lifting necessary to change the attitude of the assembly for supporting the garments.

In accordance with one aspect of the invention, a garment holder assembly comprises a support structure, first supporting means for supporting the support structure in a first attitude and second supporting means for supporting the support structure in a second attitude different from the first attitude. The support structure includes first garment support means for supporting garments when the support structure is oriented in the first attitude and second garment support means for supporting garments when the support structure is oriented in the second attitude.

In accordance with yet another aspect of the invention, a garment holder assembly comprises a rigid support structure and at least one divider secured within the supporting structure. First supporting means supports the support structure in a first attitude and second supporting means supports the support structure in a second attitude different from the first attitude.

In accordance with another aspect of the invention, the rigid support structure comprises a pair of forms secured back-to-back, each form having elongated first and second sides and first and second ends defining a closed interior portion.

These and other objects, aspects, features and advantages of the present invention will become apparent from the following detailed description of the preferred embodiment taken in conjunction with the accompanying drawings.

DESCRIPTION OF THE PREFERRED EMBODIMENT

Figure 3:
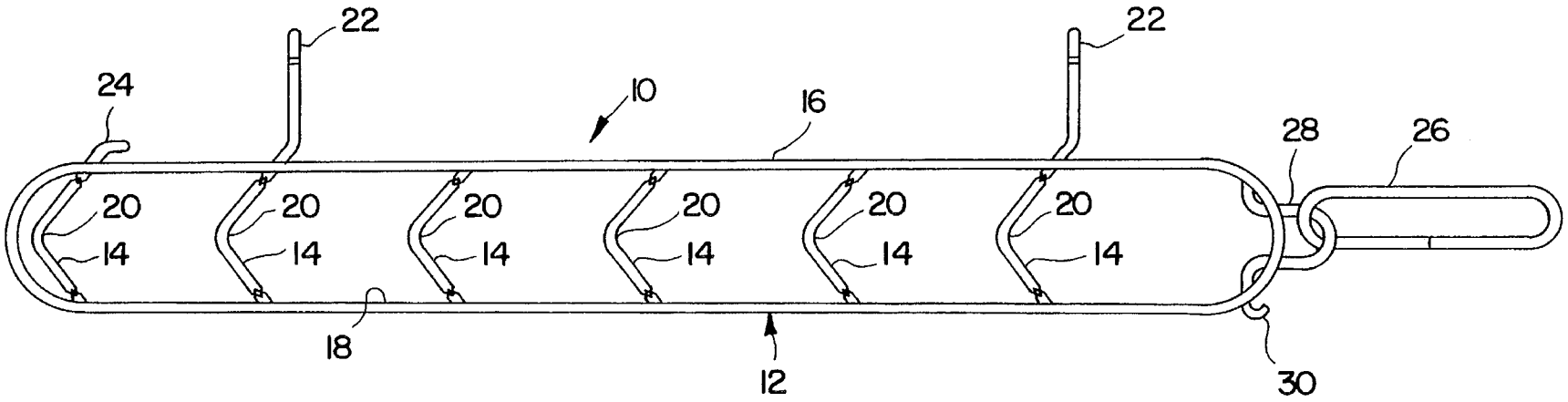
FIG. 3 is a front elevational view of a garment holder assembly in accordance with the present invention.
Figure 4:
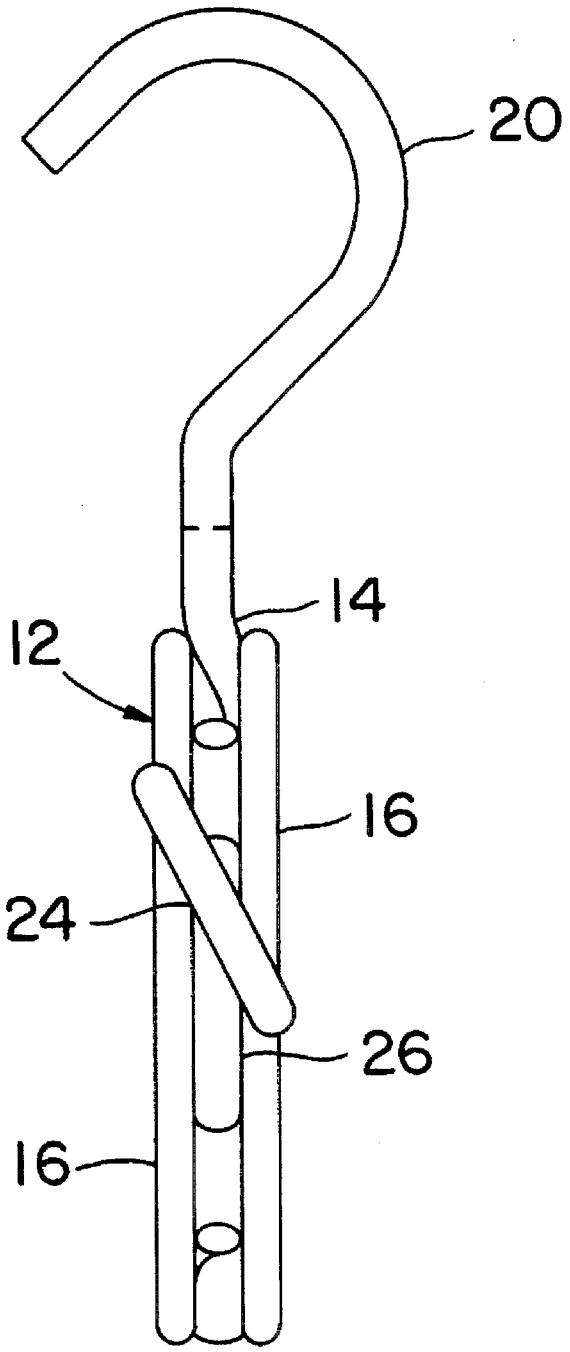
FIG. 4 is a side elevational view of the garment holder assembly in accordance with the present invention.

A garment holder assembly 10 in accordance with the present invention is shown in FIGS. 3 and 4. The detailed description of the garment holder assembly as illustrated in those Figures is made as if the assembly is positioned in a horizontal attitude. It will be appreciated, however, from the discussion below, that the garment holder assembly also supports garments when it is positioned in a vertical attitude.

The garment holder assembly 10 comprises a rigid wire support structure 12, formed in the shape of an elongated oval and having a plurality of dividers 14 secured within its closed inner portion. As best seen in FIG. 4, the support structure is preferably formed from two identically-shaped forms 16 disposed substantially in a back-to-back relationship. The forms 16 are, however, spaced from each other by the dividers 14, which are secured between the forms by, for example, welding. The forms 16 are preferably formed of a high strength material such as a metal, like stainless steel or nickel chrome plated steel. As best seen in FIG. 3, the dividers are bent at their mid-portions 20 into a V-shaped configuration. The dividers are also preferably made of a rigid material such as a metal, but could conceivably be formed from a non-rigid material without departing from the scope of this invention.

Although the configuration of the support structure 12 shown in FIG. 3 is an elongated oval specifically having two elongated sides and two curved ends, the configuration of the support structure can be varied without departing from the scope of the invention.

When the garment holder assembly is disposed in the horizontal, or first, attitude as shown in FIG. 3, it is designed to support one or more garments hanging from a lower, interior portion 18 of the support structure, that is the lower-most horizontal leg of the forms 16. The dividers 14 divide the lower interior portion into sections to help prevent the garments from bunching together when the assembly is oriented in the horizontal attitude. When the garment holder assembly is positioned in the horizontal attitude, the garments are supported to hang side-by-side with respect to one another.

At least one hook 22, and preferably two, are provided for supporting the support structure 12 in the horizontal attitude. The hooks can be individual elements secured to the support structure, or preferably may be made to be integral with two of the dividers as shown in FIG. 3. An auxiliary hook 24 for hanging, for example, plastic bags, can also be made integral with one or more of the dividers.

Figure 2:
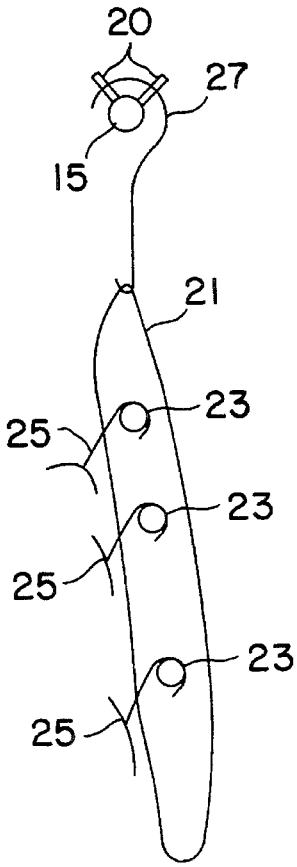
FIG. 2 PRIOR ART
FIG. 2 is a schematic side elevational view of a garment hanger known in the art.

To support the garment holder assembly in a vertical, or second, attitude, a link 26 and a closed hook 28 are provided at one end of the support structure. The closed hook is preferably welded between the two forms 16 in the same way as the dividers, and is designed to contain the link 26 while providing it freedom to be oriented in different directions. The link can be hung from a roller hook 27 of the type shown in FIG. 2 for suspending the garment holder assembly in the vertical attitude as will be described in greater detail below. An auxiliary hook 30 can also extend from the closed hook as shown in FIG. 3. Further, if only one hook 22 is incorporated in the structure it should be remote from the end of the structure carrying the link 26.

When the garment holder assembly 12 is supported in the vertical attitude, the V-shaped portions 20 of the dividers 16 support the garment hangers. When the assembly is positioned in the vertical attitude, the garments are supported to hang on top of each other or at least overlap each other to some extent.

Figure 1:
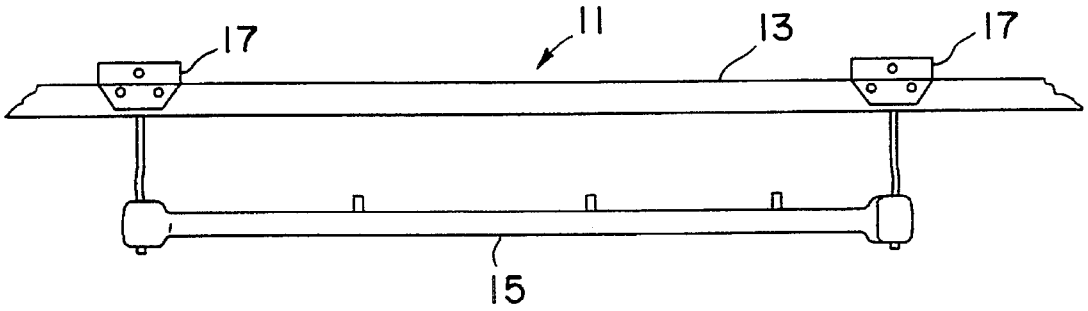
FIG. 1 PRIOR ART
FIG. 1 is a front elevational view of a conventional two-rail garment supporting assembly.
Figure 5:
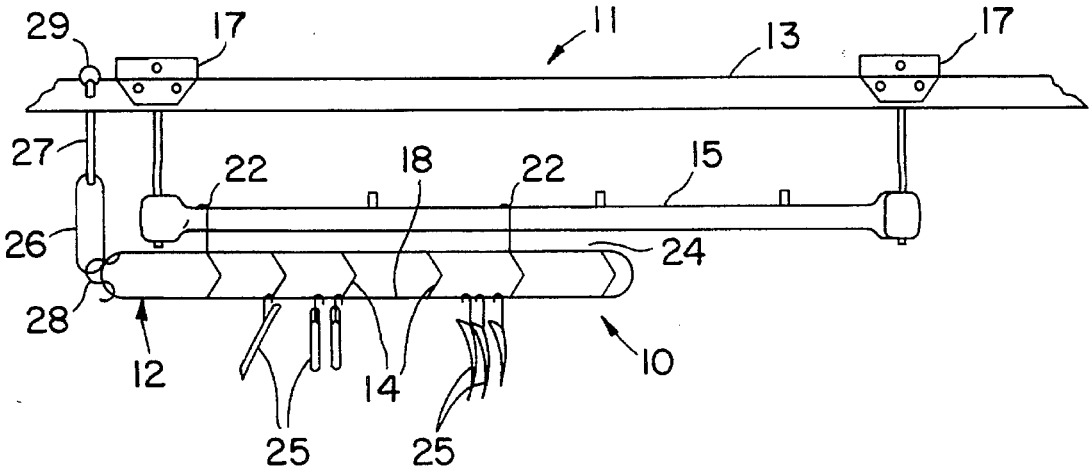
FIG. 5 is a front elevational view of the garment holder assembly of the present invention supported in a horizontal attitude on the conventional two-rail garment supporting assembly.
Figure 6:
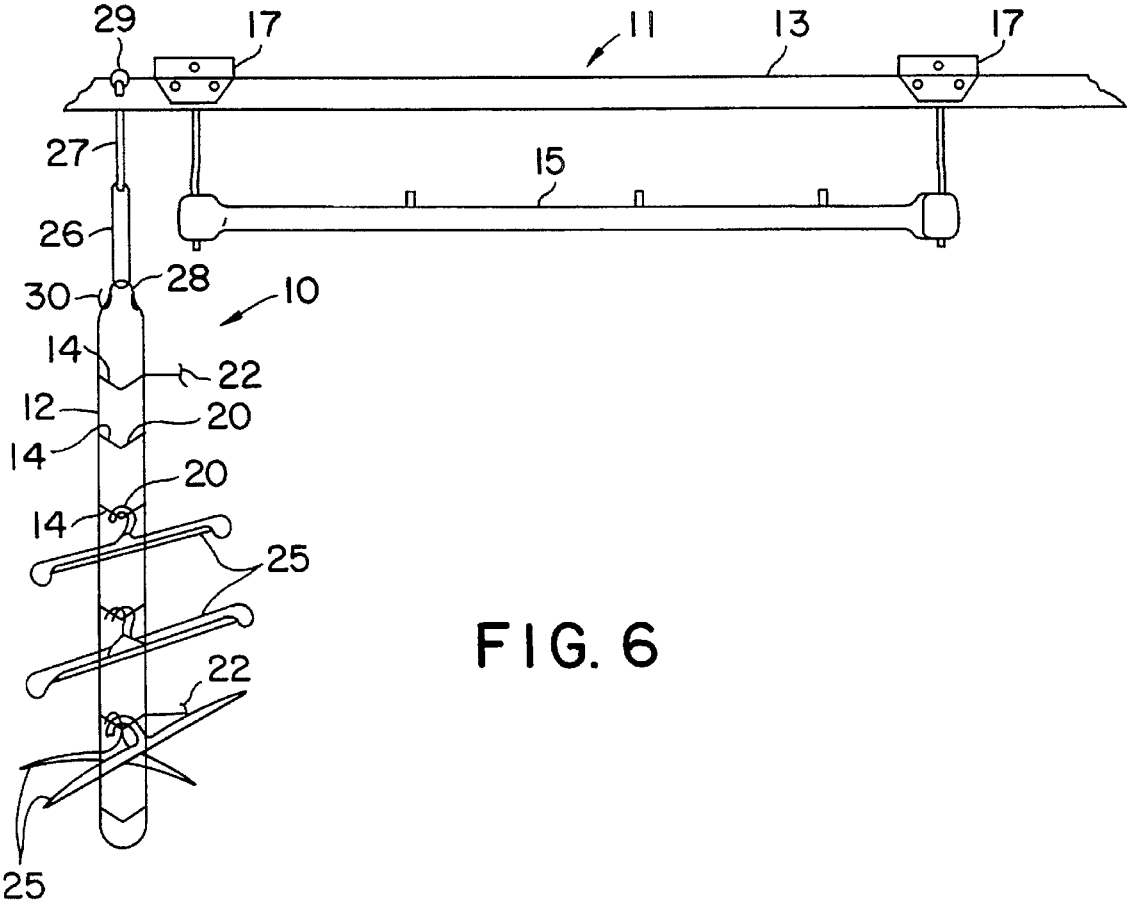
FIG. 6 is a front elevational view of the garment holder assembly of the present invention supported in a vertical attitude on the conventional two-rail garment supporting assembly.

FIGS. 5 and 6 illustrate an example of how the garment holder assembly of the present invention may be used in conjunction with the conventional two-rail garment supporting system described with reference to FIG. 1.

In this example, the garment holder assembly 10 is disposed in the horizontal attitude as shown in FIG. 5. In this attitude, hooks 22 both suspend the support structure 12 from the trolley rail 15. In this manner, the garment hangers 25 can be supported from the lower, interior portion 18 of the support structure. As will be appreciated, the link 26 can also be hooked onto conventional roller hook 27, which in turn is supported for rolling movement on the upper rail 13. Ordinarily, however, the link 26 is not connected to the roller hook at this time. With this arrangement, the garment holder assembly 10 can travel with movement of the trolley rail 15 in the horizontal direction.

To orient the garment holder assembly in the vertical attitude, as shown in FIG. 6, the link 26 is first connected to the roller hook 27, as shown in FIG. 5. The hooks 22 are then lifted one-by-one off of the trolley rail 15 preferably with the hook 22 nearest the link 26 being lifted off first. The support structure 12 may then be suspended vertically from the upper rail 13 by engagement of the link 26 with the roller hook 27.

In the vertical attitude, the V-shaped portions 20 of the dividers 16 support the garment hangers. When changing from the horizontal to the vertical attitude, the garments supported on the interior portion 18 of the support structure in the horizontal attitude will slide onto the dividers 14 and rest within the V-shaped portions 18 of the dividers. This same sliding action occurs, in reverse, when the orientation of the support structure is changed from the vertical attitude to the horizontal attitude. Thus, the garments do not have to be manually transferred when changing the attitude of the support structure.

As will be appreciated, when changing the attitude of the garment holder assembly, since one end of the support structure is supported on the upper rail 13 through link 26, only one end, i.e., the other end, has to be lifted to hook or unhook the support structure from the trolley rail. Thus, the entire weight of the garment holder assembly and any garments supported thereon does not have to be lifted when changing the attitude of the garment holding assembly, as some of the weight will continue to be supported by the upper rail. In addition, less loading and unloading of the garments is required because the garment holder assembly can be changed to different attitudes while the garments remain on the support structure.

When the holder 10 is in the vertical attitude shown FIG. 6, it can be transferred on the roller hook 27, rolling on the upper rail 3, for example, to a truck for subsequent transport. The garments on the holder can be easily covered with a plastic bag to protect them during shipment. If desired, a system similar to that shown in FIG. 1 can be provided at the shipping destination, which might be a retail store. The garment holder can then be returned to its horizontal attitude by reversing the procedure described above thus to space the garments horizontal as for display.

Accordingly, it will be appreciated that the present invention provides a novel garment holder assembly that can be oriented in two different attitudes. The garment holder assembly thus reduces the time and effort needed to store, transport and display garments. For these and other reasons described above in detail, the present invention provides substantial improvements over known garment holder assemblies.

Although a specific embodiment of the present invention has been described above in detail, it will be understood that this description is merely for purposes of illustration. Various modifications of and equivalent structures corresponding to the disclosed aspects of the preferred embodiment in addition to those described above may be made by those skilled in the art without departing from the spirit of the present invention which is defined in the following claims, the scope of which is to be accorded the broadest interpretation so as to encompass such modifications and equivalent structures.

What is claimed is:

1. A garment holder assembly, comprising:

a support structure;

first supporting means for supporting said support structure in a first attitude in a substantially horizontal orientation; and second supporting means, independent from said first supporting means, for supporting said support structure in a second attitude different from the first attitude and in a substantially vertical orientation, wherein said support structure includes first garment support means for supporting garments when said support structure is oriented in the first attitude, and second garment support means for supporting garments when said support structure is oriented in the second attitude, and wherein said support structure has an elongated side and wherein said first supporting means comprises at least one hook secured to said elongated side.

2. A garment holder assembly according to claim 1, wherein said support structure comprises an elongated rigid form defining a closed inner portion, said form being elongated horizontally when disposed in the first attitude.

3. A garment holder assembly according to claim 1, wherein said support structure comprises an elongated rigid form defining a closed inner portion, said form being elongated vertically when disposed in the second attitude.

4. A garment holder assembly, comprising:

a support structure;

first supporting means for supporting said support structure in a first attitude in a substantially horizontal orientation; and second supporting means, independent from said first supporting means, for supporting said support structure in a second attitude different from the first attitude and in a substantially vertical orientation, wherein said support structure includes first garment support means for supporting garments when said support structure is oriented in the first attitude, and second garment support means for supporting garments when said support structure is oriented in the second attitude, and wherein said support structure comprises a rigid form defining a closed inner portion, and said first garment support means is comprised of an interior surface of said inner portion.

5. A garment holder assembly, comprising:

a support structure;

first supporting means for supporting said support structure in a first attitude in a substantially horizontal orientation; and second supporting means, independent from said first supporting means, for supporting said support structure in a second attitude different from the first attitude and in a substantially vertical orientation, wherein said support structure includes first garment support means for supporting garments when said support structure is oriented in the first attitude, and second garment support means for supporting garments when said support structure is oriented in the second attitude, and said support structure comprises a rigid form defining a closed inner portion, and said second garment support means is comprised of at least one divider secured within said inner portion, wherein a plurality of said dividers are secured within said inner portion, said dividers having a V-shaped configuration for supporting garments when said support structure is oriented in the second attitude.

6. A garment holder assembly, comprising:

a support structure;

first supporting means for supporting said support structure in a first attitude; and second supporting means for supporting said support structure in a second attitude different from the first attitude, wherein said support structure includes first garment support means for supporting garments when said support structure is oriented in the first attitude, and second garment support means for supporting garments when said support structure is oriented in the second attitude, and wherein said second supporting means comprises a closed hook secured to one end of said support structure and a link secured within said hook.

7. A garment holder assembly, comprising:

a rigid support structure;

at least one divider secured within said support structure;

first supporting means for supporting said support structure in a first attitude along a first axis; and second supporting means for supporting said support structure in a second attitude along a second axis transverse to the first axis, wherein said rigid support structure comprises a form having elongated first and second sides and first and second ends defining a closed interior portion, and an interior surface of said first elongated side supports the garments when said support structure is disposed in the first attitude.

8. A garment holder assembly, comprising:

a rigid support structure;

at least one divider secured within said support structure;

first supporting means for supporting said support structure in a first attitude along a first axis; and second supporting means for supporting said support structure in a second attitude along a second axis transverse to the first axis, wherein said rigid support structure comprises a form having elongated first and second sides and first and second ends defining a closed interior portion, and a plurality of dividers are secured between said first and second sides of said form, wherein said dividers have a V-shaped configuration to support the garments when said support structure is disposed in the second attitude.

9. A garment holder assembly, comprising:

a rigid support structure;

at least one divider secured within said support structure;

first supporting means for supporting said support structure in a first attitude along a first axis; and second supporting means for supporting said support structure in a second attitude along a second axis transverse to the first axis, wherein said rigid support structure comprises a form having elongated first and second sides and first and second ends defining a closed interior portion, and a plurality of dividers are secured between said first and second sides of said form, wherein one of said dividers has an integrally-formed auxiliary hook portion extending outside of the interior portion of said support structure.

10. A garment holder assembly, comprising:

a rigid support structure;

at least one divider secured within said support structure;

first supporting means for supporting said support structure in a first attitude along a first axis; and second supporting means for supporting said support structure in a second attitude along a second axis transverse to the first axis, wherein said rigid support structure comprises a form having elongated first and second sides and first and second ends defining a closed interior portion, and a plurality of dividers are secured between said first and second sides of said form, wherein said first supporting means comprises at least one hook extending from one side in a direction transverse to said side.

11. A garment holder assembly, comprising:

a rigid support structure;

at least one divider secured within said support structure;

first supporting means for supporting said support structure in a first attitude; and second supporting means for supporting said support structure in a second attitude different from the first attitude, wherein said rigid support structure comprises a form having elongated first and second sides and first and second ends defining a closed interior portion, and wherein said second supporting means comprises a closed hook extending from one end of said support structure and a link secured within said hook.

12. A garment holder assembly, comprising:

a rigid support structure forming a closed interior portion;

at least one divider secured within the closed interior portion;

first means for supporting said support structure in a first attitude; and second means for supporting said support structure in a second attitude approximately 90° from the first attitude, wherein said rigid support structure comprises a pair of wire forms secured back-to-back, each form having elongated first and second sides and first and second ends defining the closed interior portion.

13. A garment holder assembly according to claim 12, further comprising a plurality of dividers disposed between said first and second forms and extending from said first sides of said forms to said second sides of said forms.

14. A garment holder assembly according to claim 13, wherein said dividers have a V-shaped configuration for supporting garments when said support structure is disposed in the second attitude.

15. A garment holder assembly according to claim 12, wherein an interior surface of said first sides supports the garments when said support structure is disposed in the first attitude.

16. A garment holder assembly according to claim 13, wherein said first supporting means comprises at least one hook integrally formed with one of said dividers and extending substantially perpendicular to said first side.

17. A garment holder assembly according to claim 12, wherein said second supporting means comprises a closed hook secured at one end between said first and second forms and a link secured within said closed loop.

18. A garment holder assembly according to claim 17, wherein said closed hook includes a hooked portion extending outside of the interior portion of said rigid support structure.

* * * * *